US005516305A

United States Patent [19]

Haluska

[11] Patent Number: 5,516,305

[45] Date of Patent: May 14, 1996

[54] ELECTRICAL PLUG REMOVAL DEVICE

[76] Inventor: John S. Haluska, 6436 S. Ingalls, Littleton, Colo. 80123

[21] Appl. No.: 349,965

[22] Filed: Dec. 6, 1994

[51] Int. Cl.[6] ..... H01R 13/00

[52] U.S. Cl. ..... 439/484; 439/476.1

[58] Field of Search ..... 439/483, 484, 439/476.1, 477, 371, 372, 692, 694

[56] References Cited

U.S. PATENT DOCUMENTS

| | | | |
|---|---|---|---|
| 3,431,535 | 3/1969 | Munyon | 439/484 |
| 4,210,377 | 7/1980 | La Vogue | 439/484 |
| 5,062,803 | 11/1991 | Howard et al. | 439/484 |

FOREIGN PATENT DOCUMENTS

| | | | |
|---|---|---|---|
| 2215145 | 9/1989 | United Kingdom | 439/484 |

*Primary Examiner*—Hien D. Vu
*Attorney, Agent, or Firm*—Michael A. Capraro

[57] ABSTRACT

An electrical plug removal device for use with electrical plugs of the type having an electrical cord, a cord cap or plug, and electrically conductive spaced apart blades or prongs, the electrically conductive spaced apart blades being plugged into an electrical outlet or receptacle. Many people remove an electrical plug from an electrical outlet by simply taking hold of the electrical cord and pulling on the electrical cord to remove the electrical plug from the electrical outlet. This action results in damage to the electrical cord or to the electrical plug itself that may lead to electric shock or electrocution of the person removing an electrical plug in this manner, or may lead to an electrical fire. The electrical plug removal device is constructed from thin non-conductive semi-flexible material designed to be used with a variety of electrical plugs having different types of cord caps and different shapes, configurations and numbers of electrically conductive spaced apart blades or prongs. Electrical plug blade receiving means formed in a central portion of an elongated main body accept the electrically conductive blades of the electrical plug. Other portions of the elongated main body are folded over the electrical plug and are removably joined thereby encompassing the electrical plug and the electrical cord. The end of the electrical plug removal device also has continuously formed thereon a gripping means. A users can easily and safely grasp the gripping means of the electrical plug removal device to effect the safe removal of an electrical plug from electrical outlets or receptacles without causing damage to the electrical cord or to the electrical plug.

20 Claims, 7 Drawing Sheets

ELECTRICAL PLUG REMOVAL DEVICE

BACKGROUND OF THE INVENTION

This invention relates generally to electrical plug removal devices that may be used to remove electrical plugs from an electrical outlet and more specifically to a new and novel electrical plug removal device for use with electrical plugs having an electrical cord, a cord cap or plug and electrically conductive spaced apart blades or prongs. The new and novel electrical plug removal device is designed to be used with a variety of electrical plugs having different types of cord caps and different shapes, configurations and numbers of electrically conductive spaced apart blades or prongs and particularly designed to surely and easily remove such electrical plugs from electrical outlets or receptacles.

There are many different styles and configurations of electrical plugs or cord caps. However, there are certain basic elements common to electrical plugs. Specifically, electrical plugs have an electrical cord entering a rear portion of a cord cap body and electrically conductive spaced apart blades or prongs protruding from a front portion of the cord cap body. The cord cap body may also have cupped areas or other gripping areas to aid a person in removing an electrical plug from an electrical outlet or receptacle.

Some electrical outfits or receptacles often grip the electrically conductive spaced apart blades of an electrical plug so tightly that it is difficult to remove the electrical plug from the outlet. It is especially difficult for the elderly, handicapped and others who may have disabilities or a nervous or muscular disease to easily remove an electrical plug from an electrical outlet.

Additionally, some larger types of electrical plugs or cord caps do not have cupped areas and the like which may aid in the removal of an electrical plug from an electrical outlet making it difficult for anyone to easily remove an electrical plug from an outlet. For example, many electrical plugs or cord caps found on appliances such as clothes dryers, washing machines, electric ranges and the like are constructed so the electrical cord enters the cord cap body at an angle thereby allowing the cord cap to fit behind the appliance without requiring the appliance to protrude unnecessarily from a wall. In this situation, the cord cap body is often so slender that cupped areas or other gripping areas can not be placed on the slender cord cap body. Similarly, if cupped areas or other gripping areas are present on these types of cord cap bodies, the slender nature of the cord cap body renders them ineffective.

Thus, many people remove an electrical plug from an electrical outlet by simply taking hold of the electrical cord and pulling on the electrical cord to remove the electrical plug from the electrical outlet. This action produces stress on the electrical cord itself and on the connections inside the cord cap body where the internal wires of the electrical cord are joined with the electrically conductive spaced apart blades or prongs of the electrical plug or cord cap. Removing an electrical plug from an electrical outlet in this manner may result in damage to the insulation or internal wires of the electrical cord causing the electrical device to which the electrical cord is attached to function improperly or not at all. Additionally, damage may be caused to the internal electrical connections inside the cord cap body.

The resulting damage produced by removing an electrical plug in the above described manner can be so severe that the electrical cord becomes frayed resulting in an unsafe condition that can potentially lead to electric shock or electrocution of the person removing an electrical plug in this manner. A frayed or broken electrical cord may also cause an electrical fire. If the internal electrical connections are damaged or broken, the electrical cord may pull free from the cord cap body resulting in electric shock or electrocution of the person attempting to remove an electrical plug in this manner. Even if a person is not affected by the exposed electrical wires, the possibility of an electrical fire remains and is in fact increased.

SUMMARY OF THE INVENTION

To overcome the before described considerations and problems inherent in and encountered with prior art electrical plugs, there is provided by the subject invention a unique electrical plug removal device that allows prior art electrical plugs to be easily and safely removed from prior art electrical outlets or receptacles. The new and novel electrical plug removal device is also designed to be non-conductive to prevent accidental electric shock to a user. Additionally, the new and novel electrical plug removal device is further designed to aid the elderly, handicapped and others who may have disabilities or a nervous or muscular disease that may impair or hinder their ability to grasp and remove an electrical plug from an electrical outlet or receptacle.

In the Preferred Embodiment, applicant's new and novel electrical plug removal device is continuously formed from thin non-conductive semi-flexible plastic, plastic polymers, rubber, Teflon® and the like. The electrical plug removal device is continuously formed using injection molding, molding, die cutting or other methods of continuous formation known in the art.

The electrical plug removal device is formed with an elongated main body having a surface, an opposite surface, an end, an opposite end, an end portion, an opposite end portion and a central portion. A first arm and a second arm are continuously and oppositely formed on the end of the elongated main body. The third arm and fourth arm are continuously and oppositely formed on the opposite end of the elongated main body. A gripping means is continuously formed on the third arm and fourth arm, the gripping means having an open area large enough to allow a user's finger's to pass into the open area of the gripping means. In the Preferred Embodiment, the gripping means and open area are generally oval in shape, forming a convenient handle by which the electrical plug removal device may be grasped.

Applicant's new and novel electrical plug removal device in an embodiment is designed to have a modified gripping means formed by removably joining a modified elongated first arm to a modified elongated third arm and a modified elongated second arm to a modified elongated fourth arm, respectively. In this embodiment, the modified gripping means has been designed in a T-shape, thereby forming a convenient handle which allows a user to remove a prior art electrical plug from an electrical outlet or receptacle utilizing the modified electrical plug removal device.

In the Preferred Embodiment, the new and novel electrical plug removal device is further constructed having at least two joining means, one of the at least two joining means being continuously formed on the surface of the first arm and another of the at least two joining means being continuously formed on the surface of the second arm. In the Preferred Embodiment, the at least two joining means are generally constructed in the shape of a raised stem and ball.

Also in the Preferred Embodiment, at least two joining means receptacles are continuously formed in the surface of the electrical plug removal device. One of the at least two joining means receptacles being continuously formed in the third arm and another of the at least two joining means receptacles being continuously formed in the fourth arm. The at least two joining means receptacles are generally formed as sockets capable of removably engaging the at least two joining means.

Applicant's new and novel electrical plug removal device in an embodiment is further designed to have modified at least two joining means receptacles. The modified at least two joining means receptacles are open areas or holes continuously formed in the third and fourth arms of the electrical plug removal device. The modified at least two joining means receptacles allows the ball of the at least two joining means to pass through the non-conductive semi-flexible material from which the electrical plug removal device is continuously formed. Thus, the modified at least two joining means receptacles allows the end and the opposite end of the electrical plug removal device to be securely removably joined.

Applicant's new and novel electrical plug removal device in another embodiment is further designed to have modified at least two joining means. The modified at least two joining means is an open area or hole continuously formed in the first and second arms of the electrical plug removal device and is designed to be used with the modified at least two joining means receptacles. The modified at least two joining means receptacles and the modified at least two joining means allows a fastener to be inserted through the portions of the electrical plug removal device to be joined thereby securely removably joining the end and opposite end of the electrical plug removal device. In this embodiment, the fastener has been designed to be a tee-nut and screw.

In the Preferred Embodiment, the end portion of the elongated main body has continuously formed in the surface a U-shaped channel. The U-shaped channel is continuously centrally formed in the surface having an upward angular slope, the upward angular slope beginning at the end of the elongated main body and intersecting the surface near the central portion of the elongated main body. Another U-shaped channel is similarly continuously centrally formed in the surface, the another U-shaped channel also having an upward angular slope, the upward angular slope beginning at the opposite end of the elongated main body and intersecting the surface near the central portion of the elongated main body. Also in the Preferred Embodiment, the U-shaped channels have been designed to removably encompass an electrical cord of a prior art electrical plug. The U-shaped channels continuously formed in the surface of the elongated main body produce raised portions on the opposite surface of the elongated main body of the electrical plug removal device.

Spaced apart electrical plug blade receiving means are continuously centrally formed in the central portion of the elongated main body, the spaced apart electrical plug blade receiving means being formed as openings in the central portion of the elongated main body. In the Preferred Embodiment, the configuration of the spaced apart electrical plug blade receiving means has been designed to accept the configuration of electrically conductive spaced apart blades and electrically conductive spaced apart ground blades, if present, on a prior art electrical plug.

Since there are a wide variety of shapes and configurations of electrically conductive spaced apart blades and electrically conductive spaced apart ground blades that may be present on various prior art electrical plugs, applicant's new and novel electrical plug removal device is constructed in other embodiments with varying shapes, configurations and numbers of spaced apart electrical plug blade receiving means which correspond to the shape, configuration and number of the electrically conductive spaced apart blades and electrically conductive spaced apart ground blades that may be present on a particular prior art electrical plug.

For example, there are electrical plugs of the type having two spaced apart vertical electrically conductive blades and one generally cylindrical electrically conductive spaced apart ground blade. Another type of electrical plug has two spaced apart electrically conductive blades, one of the spaced apart electrically conductive blades being horizontally positioned on the electrical plug and the other spaced apart electrically conductive blade being vertically positioned on the electrical plug. Still another type of electrical plug has three spaced apart electrically conductive blades, one blade being vertically oriented and two of the blades being angularly offset and below the vertically oriented blade. Some of these types of electrical plugs may also have an additional electrically conductive spaced apart ground blade centrally located between the spaced apart electrically conductive blades. Yet another type electrical plug has two or more spaced apart electrically conductive blades, the spaced apart electrically conductive blades being semi-circular in shape.

In the Preferred Embodiment, the electrical plug removal device also has a groove continuously transversely formed in the opposite surface of the elongated main body, the groove being continuously transversely formed in the opposite surface and being positioned between the end portion of the elongated main body and the central portion of the elongated main body. Another groove is similarly continuously transversely formed in the opposite surface of the elongated main body of the electrical plug removal device, the other groove also being continuously transversely formed in the opposite surface and being positioned between the opposite end portion of the elongated main body and the central portion of the elongated main body. In the Preferred Embodiment, the grooves have been designed to be generally V-shaped.

A prior art electrical plug is aligned with the electrical plug removal device so that the electrically conductive spaced apart blades of the electrical plug align with the spaced apart electrical plug blade receiving means of the electrical plug removal device. The electrically conductive spaced apart blades of the electrical plug is then pushed through the spaced apart electrical plug blade receiving means of the electrical plug removal device until the electrical plug rests firmly against the surface of the electrical plug removal device.

The grooves in the opposite surface of the elongated main body of the electrical plug removal device allow the end portion and the opposite end portion of the electrical plug removal device to be folded over the cord cap body of the electrical plug. The at least two joining means, continuously formed on the first arm and second arm of the electrical plug removal device and the at least two joining means receptacles formed in the third arm and the fourth arm of the electrical plug removal device are now aligned and in position to be removably joined. In the Preferred Embodiment, the first and third arms and the second and fourth arms, respectively, are pressed together until the ball and stem of the at least two joining means snaps into the at least two joining means. Once the at least two joining means have been removably engaged by the at least two joining means receptacles, the U-shaped channels formed in the surface of the electrical plug removal device removably encompass the electrical cord of the electrical plug.

After applicant's new and novel electrical plug removal device has been removably locked in position on an electrical plug, the electrical plug can be plugged into an electrical outlet or receptacle. Since the electrical plug removal device is designed to be constructed from a thin non-conductive semi-flexible material, the electrical plug removal device does not interfere with the normal function of the electrical plug in an electrical outlet or receptacle.

Applicant's new and novel electrical plug removal device allows the electrical plug to be removed from the electrical outlet or receptacle in a safe manner eliminating the necessity of removing the electrical plug by simply pulling on the electrical cord which can damage the electrical cord and other electrical connections within the cord cap body of the electrical plug. In the Preferred Embodiment, a user inserts their fingers into the open area of the gripping means and pulls on the gripping means to effect complete and safe removal of the electrical plug from the electrical outlet. The electrical plug removal device thereby prevents damage to the components of the electrical plug and the electrical cord and the non-conductive semi-flexible material from which the electrical plug removal device is constructed reduces potential danger to the user. The electrical plug removal device further provides an enlarged gripping means that can be easily and safely utilized to remove an electrical plug from an electrical outlet or receptacle.

To achieve the foregoing and other advantages, the present invention provides a new and novel electrical plug removal device designed to be used with a variety of electrical plugs having different types of cord caps and different shapes, configurations and numbers of electrically conductive spaced apart blades or prongs and particularly designed to safely and easily remove such electrical plugs from electrical outlets.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel electrical plug removal device that provides safe and easy removal of an electrical plug from an electrical outlet or receptacle.

Another object and advantage of the invention is to provide a new and novel electrical plug removal device that does not damage an electrical cord or the internal electrical connections of an electrical plug.

Another object and advantage of the invention is to provide a new and novel electrical plug removal device that does not interfere with the normal functioning of an electrical plug.

Another object and advantage of the invention is to provide a new and novel electrical plug removal device that is non-conductive.

Another object and advantage of the invention is to provide a new and novel electrical plug removal device that can be utilized on a variety of electrical plugs.

Still another object and advantage of the invention is to provide a new and novel electrical plug removal device that can be utilized with varying shapes, configurations and numbers of electrically conductive blades that may be found on electrical plugs.

Another object and advantage of the invention is to provide a new and novel electrical plug removal device which may be easily and efficiently manufactured and marketed.

Yet another object and advantage of the invention is to provide a new and novel electrical plug removal device which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
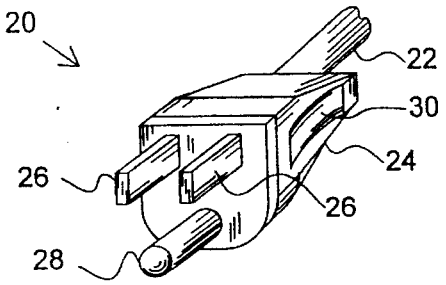
Figure 1 Prior Art
FIG. 1 is a perspective view of a prior art three-bladed electrical plug.
Figure 2:
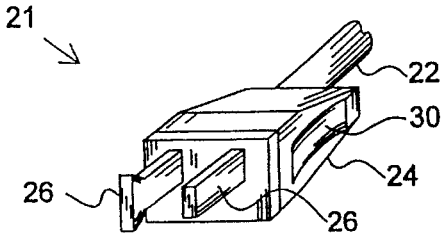
Figure 2 Prior Art
FIG. 2 is a perspective view of a prior art two-bladed electrical plug.

Referring to the drawings in general and in particular to FIGS. 1 and 2 of the drawings, there is shown typical prior art electrical plugs or cord caps. FIG. 1 of the drawings is a perspective view of a prior art three-bladed electrical plug shown generally by the numeral 20. FIG. 2 of the drawings is a perspective view of a prior art two-bladed electrical plug shown generally by the numeral 21.

While there are many different styles and configurations of electrical plugs or cord caps, there are certain basic elements common to prior art electrical plugs. Prior art electrical plugs 20 and 21 have an electrical cord 22 entering a rear portion of a cord cap body 24. Only a portion of an electrical cord 22 has been shown in FIGS. 1 and 2 for purposes of clarity. A front portion of the cord cap body 24 has protruding therefrom electrically conductive spaced apart prongs or blades 26. Some typical prior art electrical plugs 20 may have an electrically conductive spaced apart ground blade 28 as shown in FIG. 1 of the drawings. However, not all prior art electrical plugs 21 have an electrically conductive spaced apart ground blade 28 as shown in FIG. 2 of the drawings.

The cord cap body 24 may also have cupped areas 30 or other gripping areas to aid a user in removing an electrical plug 20 and 21 from an electrical outlet or receptacle. Some electrical outlets or receptacles often grip the electrically conductive spaced apart blades 26 and, if present, the electrically conductive spaced apart ground blade 28 so tightly that it is difficult for people to remove the electrical plug 20 and 21 from the outlet. It is especially difficult for the elderly, handicapped and others who may have disabilities or a nervous or muscular disease to easily remove an electrical plug 20 and 21 from an electrical outlet. Additionally, some larger types of electrical plugs or cord caps, as well as specially designed angled cord caps, do not have gripping areas like the cupped areas 30 which may aid in the removal of an electrical plug 20 and 21 from an electrical outlet or receptacle making it difficult for anyone to easily remove an electrical plug from an outlet.

Thus, many people remove an electrical plug 20 and 21 from an electrical outlet or receptacle by simply taking hold of the electrical cord 22 and pulling on the electrical cord 22 to remove the electrical plug 20 and 21 from an electrical outlet or receptacle. This action produces stress on the electrical cord 22 itself and on the connections inside of the cord cap body 24 where the internal wires in the electrical cord 22 are joined with the electrically conductive spaced apart blades 26 and, if present, the electrically conductive spaced apart ground blade 28. Removing electrical plugs 20 and 21 from an electrical outlet in the above described manner may result in damage to the insulation or internal wires of the electrical cord 22 causing the electrical device to which the electrical cord 22 is attached to function improperly or not at all. Additionally, damage may be caused to the internal electrical connections inside the cord cap body 24. The resulting damage can become so severe that the electrical cord 22 becomes frayed resulting in an unsafe condition that can potentially lead to electric shock or electrocution of the user removing an electrical plug 20 and 21 in this manner or may cause an electrical fire. Also, the internal electrical connection may be suddenly broken causing the electrical cord 22 to pull free from the cord cap body 24 resulting in potential electric shock or electrocution of the user removing an electrical plug 20 and 21 in this manner or may cause an electrical fire or both. Applicant's new and novel electrical plug removal device has been designed to eliminate removal of an electrical plug or cord cap 20 and 21 from an electrical outlet or receptacle in an unsafe manner as will be discussed more fully hereinafter.

The electrical plugs 20 and 21 shown in FIGS. 1 and 2 of the drawings have been designed to illustrate typical prior art electrical plugs or cord caps found on a wide variety of electrical devices. There are many different styles and configurations of electrical plugs or cord caps 20 and 21 as well as many different styles, numbers and configurations of the electrically conductive spaced apart blades 26 and the electrically conductive spaced apart ground blade 28 found on different types of prior art electrical plugs or cord caps 20 and 21. Applicant's new and novel electrical plug removal device has been designed to be used with a variety of designs and configurations of prior art electrical plugs as will be more fully described hereinafter. The prior art electrical plugs 20 and 21 shown in the Preferred Embodiment and in FIGS. 1 and 2 of the drawings have been designed for purposes of illustration only. Other electrical plugs or cord caps can be used with one or more embodiments of the applicant's new and novel electrical plug removal device.

Referring now in general to FIGS. 3 through 12 there will be described in detail applicant's new and novel electrical plug removal device shown generally by the numeral 32. In the Preferred Embodiment, applicant's new and novel electrical plug removal device 32 is constructed from thin non-conductive semi-flexible plastic, plastic polymers, rubber, Teflon® and the like. Other thin non-conductive semi-flexible materials may also be used and are considered to be within the spirit and scope of the applicant's invention. Also in the Preferred Embodiment, applicant's new and novel electrical plug removal device 32 is continuously formed by injection molding, molding, die cutting or other methods of continuous formation known in the art.

Figure 3:
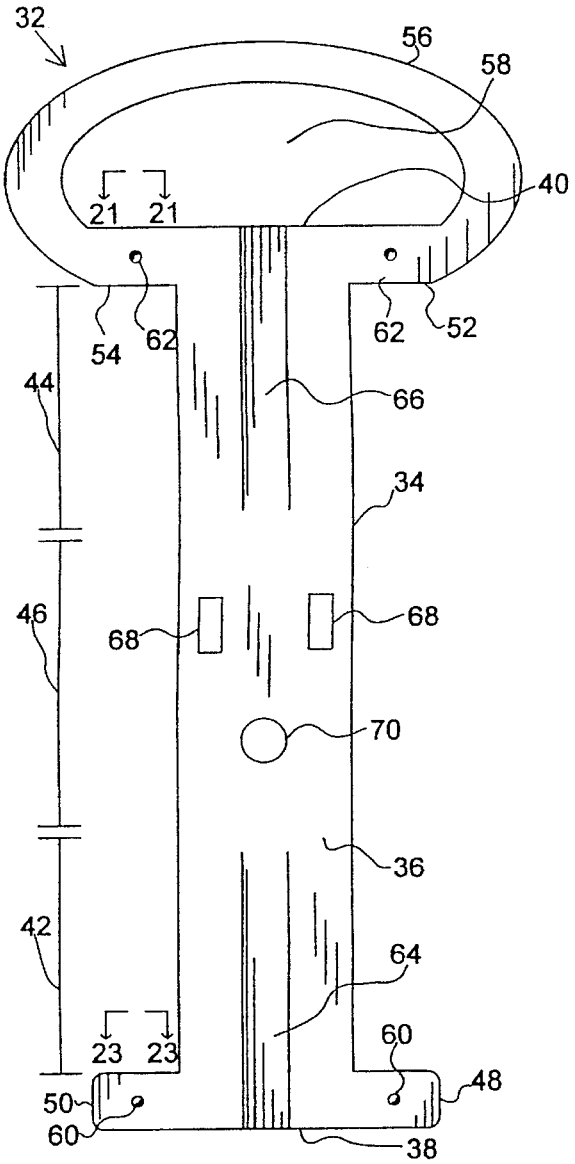
FIG. 3 is a top plan view of applicant's new and novel electrical plug removal device.

Referring now to FIG. 3 of the drawings in particular, there is shown a top plan view of applicant's new and novel electrical plug removal device 32. An elongated main body 34, having a surface 36, end 38, opposite end 40, end portion 42, opposite end portion 44 and central portion 46 has continuously formed thereon a first arm 48 and a second arm 50, the first arm 48 and the second arm 50 being oppositely and continuously formed on end 38 of the elongated main body 34. Third arm 52 and fourth arm 54 are continuously and oppositely formed on opposite end 40 of elongated main body 34. Gripping means 56 is continuously formed on third arm 52 and fourth arm 54, gripping means 56 having an open area 58. In the Preferred Embodiment, gripping means 56 and open area 58 are generally oval in shape, forming a convenient handle by which the electrical plug removal device 32 may be grasped as will be discussed more fully hereinafter. Other shapes and configurations may also be used and are considered to be within the spirit and scope of the applicant's invention.

First arm 48 and second arm 50 have continuously formed on surface 36 at least two joining means 60. In the Preferred Embodiment, the at least two joining means 60 are generally constructed in the form of a raised stem and ball and will be discussed more fully hereinafter. Other shapes and configurations may also be used and are considered to be within the spirit and scope of the applicant's invention.

At least two joining means receptacles 62 are continuously formed in surface 36 of third arm 52 and fourth arm 54. In the Preferred Embodiment, the at least two joining means receptacles 62 are generally formed as sockets capable of removably engaging the at least two joining means 60 and will be discussed more fully hereinafter. Other shapes and configurations may also be used and are considered to be within the spirit and scope of the applicant's invention.

End portion 42 of elongated main body 34 has continuously formed in surface 36 U-shaped channel 64. In the Preferred Embodiment, U-shaped channel 64 is continuously centrally formed in surface 36 having an upward angular slope, the upward angular slope beginning at end 38 and intersecting surface 36 near central portion 46 of elongated main body 34. Another U-shaped channel 66 is similarly continuously centrally formed in surface 36, another U-shaped channel 66 also having an upward angular slope, the upward angular slope beginning at opposite end 40 and intersecting surface 36 near central portion 46 of elongated main body 34. In the Preferred Embodiment, U-shaped channels 64 and 66 have been designed to receive an electrical cord 22 of a prior art electrical plug 20, the electrical cord 22 and the electrical plug 20 not shown in FIG. 3 of the drawings for purposes of clarity but which are shown in FIGS. 1 and 2 of the drawings. Other channel configurations may also be used and are considered to be within the spirit and scope of the applicant's invention. U-shaped channels 64 and 66 will be discussed more fully hereinafter.

Still referring to FIG. 3 of the drawings there is shown spaced apart electrical plug blade receiving means 68 and 70 continuously centrally formed in central portion 46 of elongated main body 34. The configuration of spaced apart electrical plug blade receiving means 68 and spaced apart electrical plug blade receiving means 70 is shown in the Preferred Embodiment and in FIG. 3 of the drawings for purposes of illustration only. Applicant's new and novel electrical plug removal device 32 may also be designed with spaced apart electrical plug blade receiving means 68 and spaced apart electrical plug blade receiving means 70 having other shapes, designs, configurations, sizes and numbers designed to accept different shapes, designs, configurations, sizes and numbers of electrically conductive spaced apart blades 26 and electrically conductive spaced apart ground blades 28, not shown in FIG. 3 of the drawings but which are clearly shown in FIGS. 1 and 2 of the drawings. Spaced apart electrical plug blade receiving means 68 and 70 will be discussed more fully hereinafter.

Figure 4:
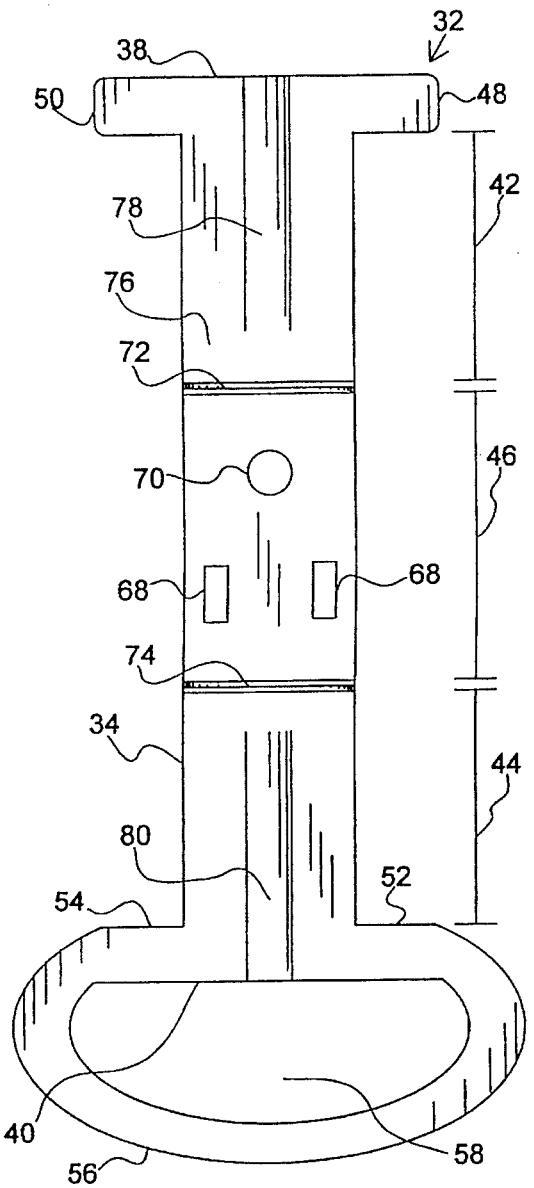
FIG. 4 is a bottom plan view of applicant's new and novel electrical plug removal device.

Referring now to FIG. 4 of the drawings there is shown a bottom plan view of applicant's new and novel electrical plug removal device, shown generally by the numeral 32. Groove 72 is continuously transversely formed in opposite surface 76 of elongated main body 34 of electrical plug removal device 32, groove 72 being continuously transversely formed in opposite surface 76 between end portion 42 of elongated main body 34 and central portion 46 of elongated main body 34. Another groove 74 is similarly continuously transversely formed in opposite surface 76 of elongated main body 34 of electrical plug removal device 32, groove 74 being continuously transversely formed in opposite surface 76 between end portion 44 of elongated main body 34 and central portion 46 of elongated main body 34. In the Preferred Embodiment, grooves 72 and 74 have been designed to be generally V-shaped and will be discussed more fully hereinafter. Other shapes and configurations may also be used and are considered to be within the spirit and scope of the applicant's invention.

Still referring to FIG. 4 of the drawings there is shown raised portion 78 and another raised portion 80 on opposite surface 76 of elongated main body 34. Raised portions 78 and 80 result from U-shaped channel 64 and another U-shaped channel 66, respectively, continuously centrally formed in surface 36 as previously described. Surface 36 and U-shaped channels 64 and 66 are not visible in FIG. 4 of the drawings but are clearly seen in FIG. 3 of the drawings.

Figure 5:
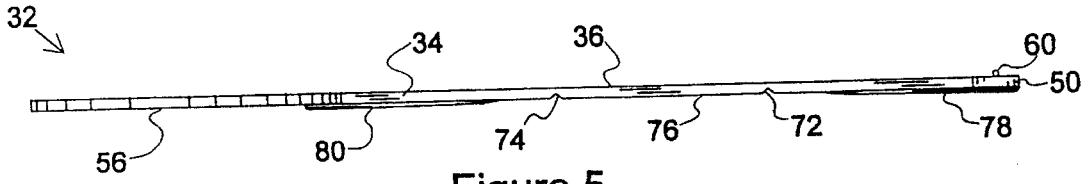
FIG. 5 is a side elevational view of applicant's new and novel electrical plug removal device.

Referring now to FIG. 5 of the drawings there is shown a side elevational view of applicant's new and novel electrical plug removal device shown generally by the numeral 32. FIG. 5 of the drawings illustrates the thin nature of the non-conductive semi-flexible material from which the electrical plug removal device 32 is continuously formed. The electrical plug removal device 32 is continuously formed from thin non-conductive semi-flexible material to prevent interference of the electrical plug removal device 32 with the normal functioning of an electrical plug as will be discussed more fully hereinafter.

FIG. 5 of the drawings also illustrates the continuously formed raised stem and ball construction of the at least two joining means 60 which will be discussed more fully hereinafter. Only one of the at least two joining means 60 is visible in FIG. 5 of the drawings. The thickness of the non-conductive semi-flexible material from which the electrical plug removal device 32 is continuously formed and the interaction of the at least two joining means 60 with the at least two joining means receptacles 62, which are not visible in FIG. 5 of the drawings but are clearly shown in FIG. 3, will also be discussed more fully hereinafter.

Referring now in general to FIGS. 6 through 12 of the drawings, there will be described in detail how applicant's new and novel electrical plug removal device, shown generally by the numeral 32, is positioned on and utilized with a typical prior art electrical plug, shown generally by the numeral 20. Since there are many different styles and configurations of electrical plugs or cord caps 20 as well as many different styles, numbers and configurations of the electrically conductive spaced apart blades 26 and the electrically conductive spaced apart ground blade 28 found on different types of prior art electrical plugs or cord caps, as previously described, the prior art electrical plug 20 shown in the Preferred Embodiment and in FIGS. 6, 7, 8,11 and 12 of the drawings has been designed for purposes of illustration only. Other electrical plugs or cord caps having other styles and configurations may be used with one or more embodiments of the applicant's new and novel electrical plug removal device as will be discussed more fully hereinafter.

Figure 6:
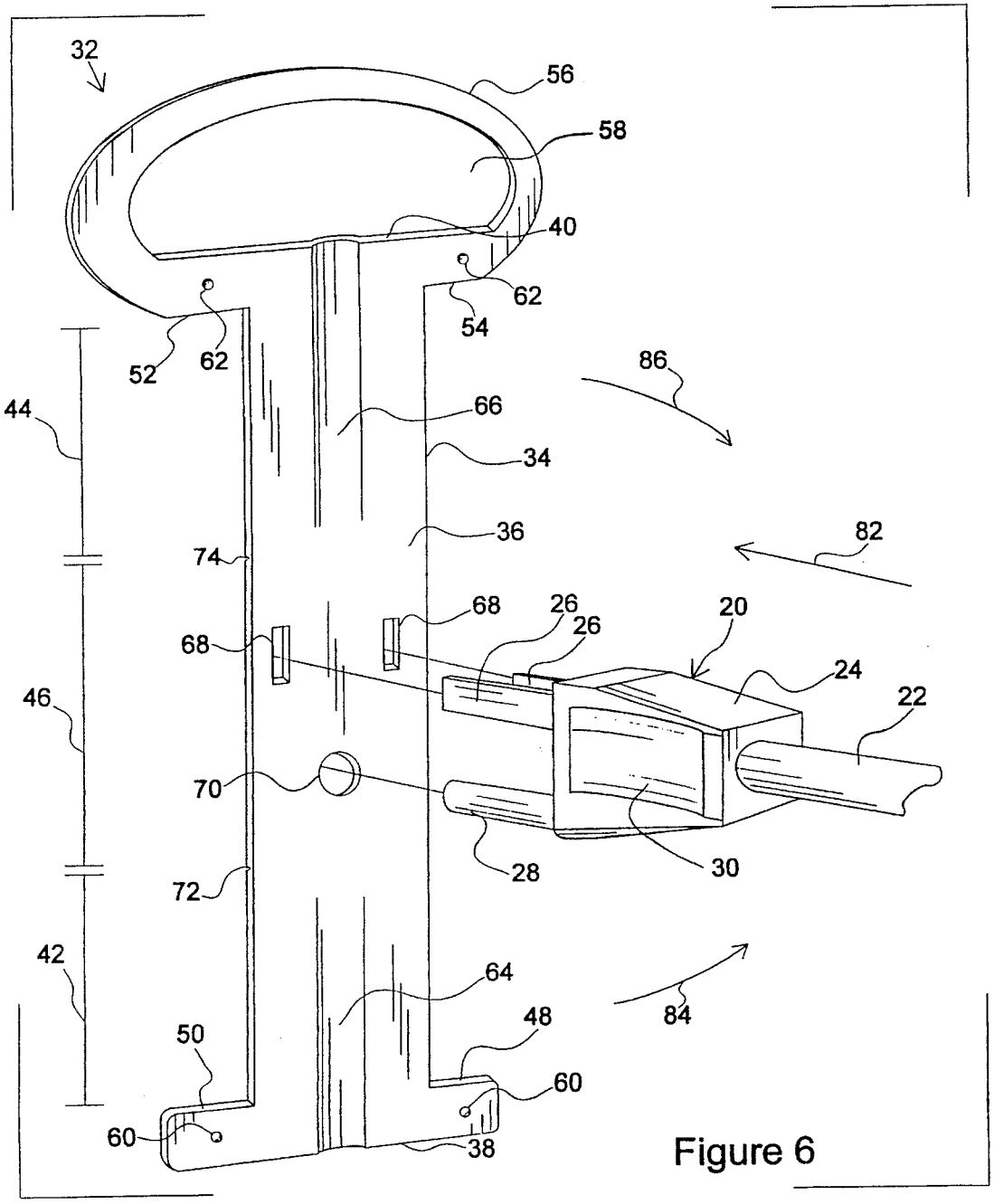
FIG. 6 is a perspective view of applicant's new and novel electrical plug removal device positioned to receive a prior art electrical plug.

Referring now to FIG. 6 of the drawings there is shown a perspective view of applicant's new and novel electrical plug removal device 32 in position to receive a prior art electrical plug 20. Prior art electrical plug 20 is aligned with electrical plug removal device 32 so that electrically conductive spaced apart blades 26 align with spaced apart electrical plug blade receiving means 68 and electrically conductive spaced apart ground blade 28, if present, aligns with spaced apart electrical plug blade receiving means 70.

The configuration of spaced apart electrical plug blade receiving means 68 and spaced apart electrical plug blade receiving means 70 is shown in the Preferred Embodiment and in FIG. 6 of the drawings for purposes of illustration only. Applicant's new and novel electrical plug removal device 32 may also be designed with spaced apart electrical plug blade receiving means 68 and spaced apart electrical plug blade receiving means 70 having other shapes, designs, configurations, sizes and numbers designed to accept different configurations of electrically conductive spaced apart blades 26 and electrically conductive spaced apart ground blades 28 as will be discussed more fully hereinafter.

Still referring to FIG. 6 of the drawings, after prior art electrical plug 20 is aligned with electrical plug removal device 32, electrically conductive spaced apart blades 26 and electrically conductive spaced apart ground blade 28 of prior art electrical plug 20 is pushed into spaced apart electrical plug blade receiving means 68 and 70 in the direction of arrow 82 until prior art electrical plug 20 rest firmly against surface 36 of electrical plug removal device 32. End portion 42 of electrical plug removal device 32 is folded onto the cord cap body 24 of the prior art electrical plug 20 in the direction of arrow 84. Similarly, opposite end portion 44 of electrical plug removal device 32 is folded onto the cord cap body 24 of the prior art electrical plug 20 in the direction of arrow 86. Applicant's new and novel electrical plug removal device 32 is now in position to be removably locked into place on the prior art electrical plug 20 as shown in FIGS. 7 and 8 of the drawings.

Figure 7:
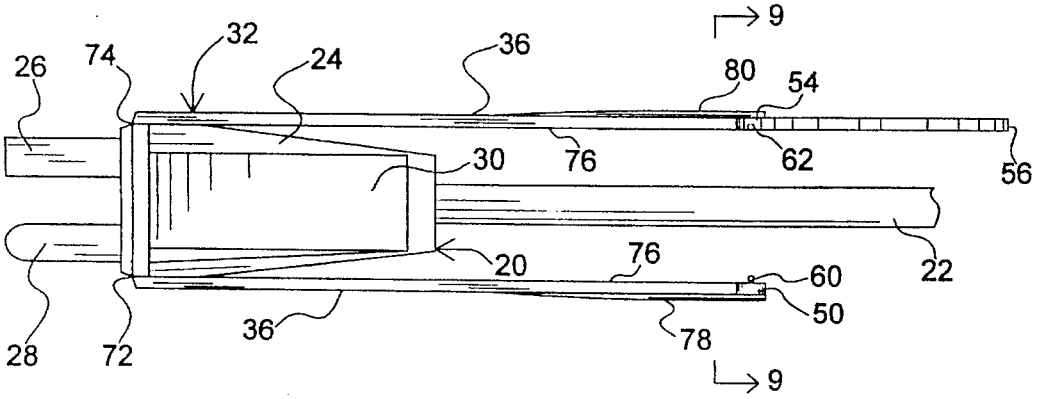
FIG. 7 is a side elevational view of applicant's new and novel electrical plug removal device in a removably unlocked position on a prior art electrical plug.

Referring now to FIG. 7 of the drawings there is shown a side elevational view of applicant's new and novel electrical plug removal device, shown generally by the numeral 32, in a removably unlocked position on a prior art electrical plug, shown generally by the numeral 20. FIG. 7 illustrates the natural alignment of the at least two joining means 60 with the at least two joining means receptacles 62, which has been shown in dashed lines for purposes of clarity, resulting from the natural fold of the electrical plug removal device 32 at groove 72 and at another groove 74 when electrical plug removal device 32 is properly positioned on a prior art electrical plug 20. Only one of the at least two joining means 60 and only one of the at least two joining means receptacles 62, shown in dashed lines in FIG. 7 for purposes of clarity, are clearly visible in FIG. 7 of the drawings. The at least two joining means 60 and the at least two joining means receptacles 62 will be discussed more fully hereinafter.

Figure 8:
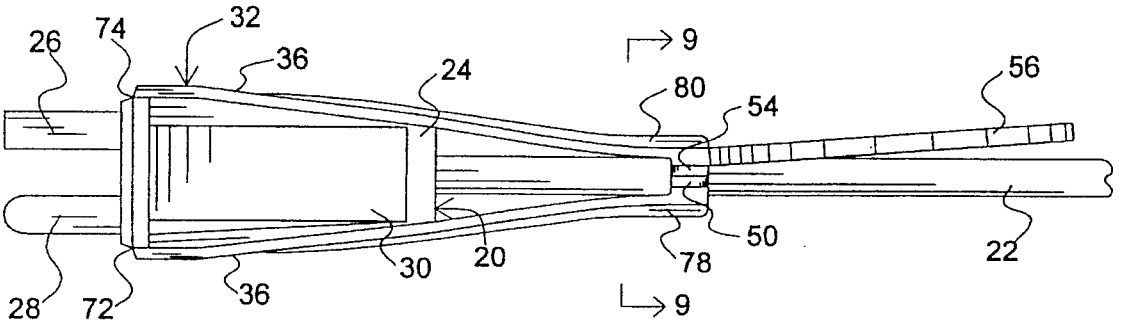
FIG. 8 is a side elevational view of applicant's new and novel electrical plug removal device in a removably locked position on a prior art electrical plug.

Referring now to FIG. 8 of the drawings there is shown a side elevational view of applicant's new and novel electrical plug removal device, shown generally by the numeral 32, in a removably locked position on a prior art electrical plug, shown generally by the numeral 20. First arm 48 and third arm 52 are pressed together and second arm 50 and fourth arm 54 are pressed together. The resulting pressure on the before mentioned arms, 48, 50, 52 and 54, causes the at least two joining means 60 continuously formed on first arm 48 and second arm 50 to be removably engaged by the at least two joining means receptacles 62 continuously formed in third arm 52 and fourth arm 54, respectively, thus removably locking the electrical plug removal device 32 in place on the prior art electrical plug 20. First arm 48, third arm 52, the at least two joining means 60 and at least two joining means receptacles 62 are not visible in FIG. 8 of the drawings but are clearly shown in FIG. 3 of the drawings.

Still referring to FIG. 8 of the drawings, when first arm 48 and third arm 52 are pressed together and second arm 50 and fourth arm 54 are pressed together, U-shaped channels 64 and 66 removably encompass electrical cord 22 of the prior art electrical plug 20. U-shaped channels 64 and 66 are not visible in FIG. 8 of the drawings but are clearly shown in FIG. 3 of the drawings. Additionally, the manner in which U-shaped channels 64 and 66 removably encompass electrical cord 22 of the prior art electrical plug 20 is clearly illustrated in FIGS. 11 and 12 of the drawings and will be discussed more fully hereinafter.

Still referring to FIG. 8 of the drawings, the nature of the thickness of the electrical plug removal device 32 is further illustrated. The electrical plug removal device 32 is designed to be thin to prevent interference with the ability of a prior art electrical outlet or receptacle, not shown in FIG. 8 of the drawings for purposes of clarity, to firmly and safely grasp electrically conductive spaced apart blades 26 and, if present, electrically conductive spaced apart ground blade 28. In the Preferred Embodiment, electrical plug removal device 32 is designed to be from 1/64 of an inch to 1/8 of inch in thickness. Other thicknesses may also be used and are considered to be within the spirit and scope of the applicant's invention.

Since there is a wide variety of shapes and configurations of electrically conductive spaced apart blades 26 and electrically conductive spaced apart ground blades 28 on prior art electrical plugs 20, variations in the thickness of electrical plug removal device 32 corresponds to the particular shape and configuration of the electrically conductive spaced apart blades 26 and electrically conductive spaced apart ground blades 28 on the particular prior art electrical plug on which the electrical plug removal device 32 is to be used. Additionally, modifications of the at least two joining means 60 and the at least two joining means receptacles 62, not shown in FIG. 8 of the drawings for purposes of clarity, may also be utilized and will be discussed more fully hereinafter. The at least two joining means 60 and at least two joining means receptacles 62 are not visible in FIG. 8 of the drawings but are clearly shown in FIG. 3 of the drawings.

Figure 9:
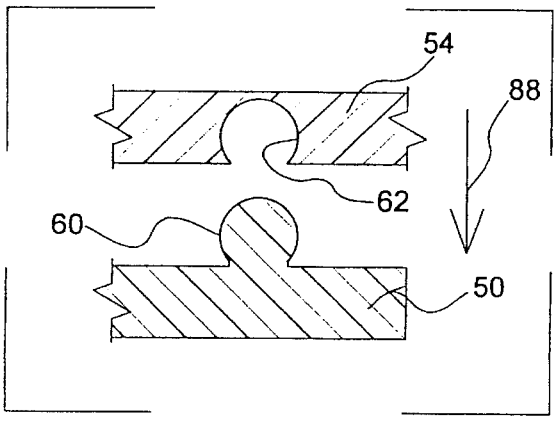
FIG. 9 is an enlarged cross sectional view of a portion applicant's new and novel electrical plug removal device taken along lines 9—9 of FIG. 7.
Figure 10:
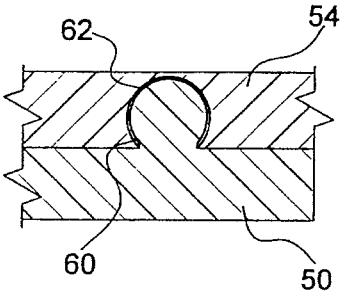
FIG. 10 is an enlarged cross sectional view of a portion applicant's new and novel electrical plug removal device taken along lines 10—10 of FIG. 8.

Referring now to FIGS. 9 and 10 of the drawings there is shown an enlarged cross sectional view of a portion of second arm 50 and fourth arm 54 of the electrical plug removal device 32. FIG. 9 is an enlarged cross sectional view taken along lines 9—9 of FIG. 7 of the drawings. FIG. 10 is an enlarged cross sectional view taken along lines 10—10 of FIG. 8 of the drawings.

Referring now in particular to FIG. 9 of the drawings, there is shown the ball and stem construction of one of the at least two joining means 60 continuously formed on second arm 50 and the socket construction of one of the at least two joining means receptacles 62 continuously formed in fourth arm 54. In the Preferred Embodiment, the at least two joining means 60 have been designed to snap into the at least two joining means receptacles 62 when second arm 50 and fourth arm 54 are pressed together in the direction of arrow 88 thereby joining second arm 50 and fourth arm 54 and thus, joining end 38 and opposite end 40 of the electrical plug removal device 32. Another at least two joining means 60 and another at least two joining means receptacle 62 are similarly continuously formed on first arm 48 and continuously formed in third arm 52, respectively, thereby completing the joining of end 38 and opposite end 40 of the electrical plug removal device 32 when pressed together in a like manner. The another at least two joining means 60, another at least two joining means receptacles 62, first arm 48, third arm 52, end 38 and opposite end 40 are not shown in FIG. 9 of the drawings for purposes of clarity.

Referring now to FIG. 10 of the drawings there is shown a cross sectional view of a portion of second arm 50 and fourth arm 54 of the electrical plug removal device 32, taken along lines 10—10 of FIG. 8 of the drawings, showing an at least two joining means 60 removably engaged by an at least two joining means receptacles 62. When the at least two joining means 60 have been removably engaged by the at least two joining means receptacles 62, applicant's new and novel electrical plug removal device 32 is safely and securely removably fixed in position on a prior art electrical plug 20. All of the at least two joining means 60, the at least two joining means receptacles 62, the entire electrical plug removal device 32 and a prior art electrical plug have not been shown in FIGS. 9 and 10 of the drawings for purposes of clarity. See generally, FIGS. 1 through 8 of the drawings.

Figure 11:
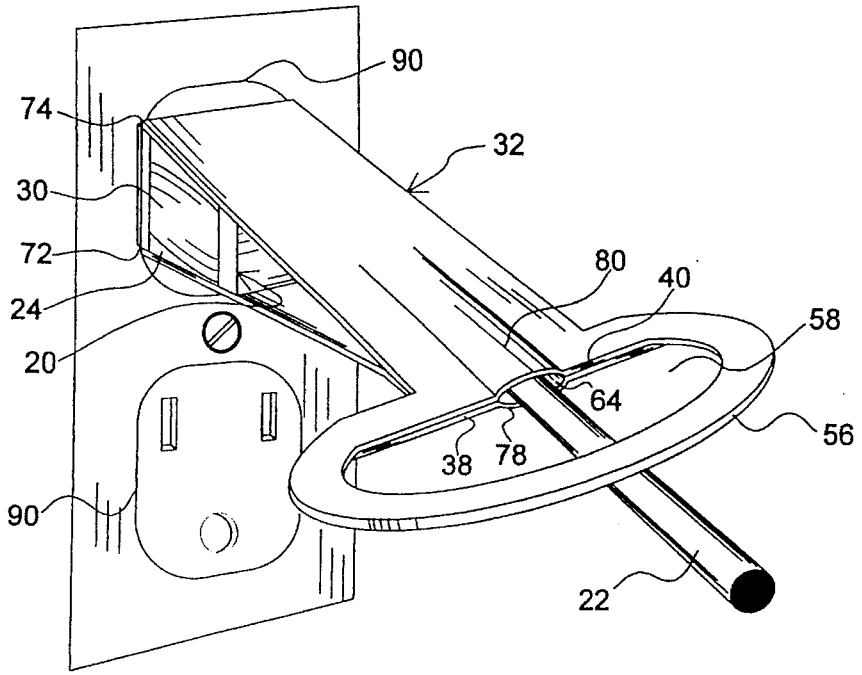
FIG. 11 is a perspective view of applicant's new and novel electrical plug removal device shown in a removably locked position on a prior art electrical plug plugged into a prior art electrical wall outlet.

Referring now to FIG. 11 of the drawings there is shown applicant's new and novel electrical plug removal device, shown generally by the numeral 32, in a removably locked position on a prior art electrical plug, shown generally by the numeral 20, plugged into a typical prior art electrical wall outlet or receptacle, shown generally by the numeral 90. FIG. 11 is a perspective view of applicant's new and novel electrical plug removal device 32 in a removably locked position on a prior art electrical plug 20 plugged into a typical prior art electrical wall outlet 90.

When an electrical plug 20 is to be removed from a wall outlet 90 without the aid of applicant's new and novel electrical plug removal device 32, a user must grasp the cupped area 30, if present, of the electrical plug 20 and pull the electrical plug 20 from the wall outlet 90. Some electrical outlets or receptacles 90 often grip the electrically conductive spaced apart blades 26 and, if present, the electrically conductive spaced apart ground blade 28, which are not visible in FIG. 11 of the drawings, so tightly that it is difficult for people to remove the electrical plug 20 from the outlet 90. It is especially difficult for the elderly, handicapped and others who may have disabilities or a nervous or muscular disease to easily remove an electrical plug 20 from an electrical outlet 90. Thus, many people remove an electrical plug 20 from an electrical outlet or receptacle 90 by simply taking hold of the electrical cord 22 and pulling on the electrical cord 22 to remove the electrical plug 20 from the wall outlet 90. This action produces stress on the electrical cord 22 itself and on the connections inside of the cord cap body 24 where the internal wires in the electrical cord 22 are joined with the electrically conductive spaced apart blades 26 and, if present, the electrically conductive spaced apart ground blade 28. Removing an electrical plug 20 from an electrical outlet or receptacle 90 in the above described manner may result in damage to the insulation or internal wires of the electrical cord 22 causing the electrical device to which the electrical cord 22 is attached to function improperly or not at all. Additionally, damage may be caused to the internal electrical connections inside the cord cap body 24. The resulting damage can become so severe that the electrical cord 22 becomes frayed resulting in an unsafe condition that can potentially lead to electric shock or electrocution of the user removing an electrical plug 20 in this manner or the damage may cause an electrical fire. Also, the internal electrical connections may be suddenly broken causing the electrical cord 22 to pull free form the cord cap body 24 resulting in potential electric shock or electrocution of the user removing an electrical plug 20 in this manner or may cause an electrical fire or both.

Figure 12:
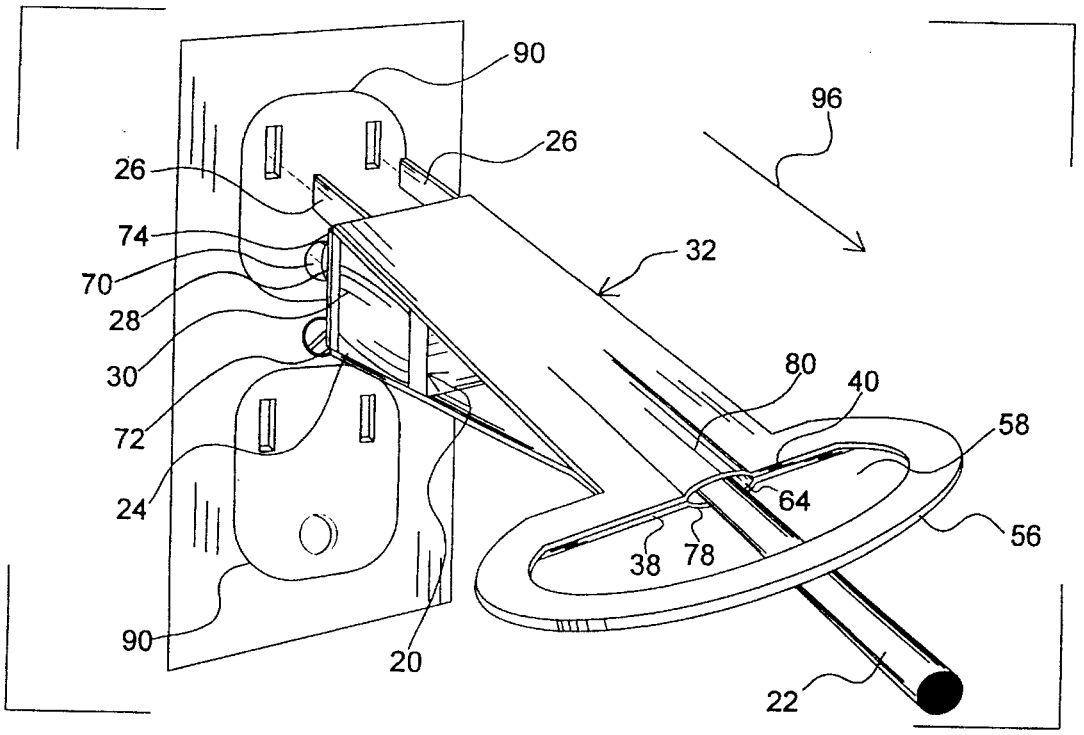
FIG. 12 is a perspective view of applicant's new and novel electrical plug removal device in a removably locked position on a prior art electrical plug removed from a prior art electrical wall outlet.

Referring now to FIG. 12 of the drawings there is shown how applicant's new and novel electrical plug removal device eliminates removal of the electrical plug 20 from the wall outlet 90 in an unsafe manner thereby reducing stress on the electrical cord 22 and electrical connections within the cord cap body 24. FIG. 12 is a perspective view of applicant's new and novel electrical plug removal device 32 in a removably locked position on a prior art electrical plug 20 being removed from a typical prior art electrical wall outlet 90.

To remove an electrical plug 20 utilizing the electrical plug removal device 32, a user inserts their fingers into open area 58 of gripping means 56. A user's fingers need not completely encircle the gripping means 56 of electrical plug removal device 32, which may be difficult for some elderly, handicapped and others who may have disabilities or a nervous or muscular disease, to effect removal of the electrical plug 20 from the wall outlet 90. Simply pulling on the gripping means 56, in the direction of arrow 96 as illustrated in FIG. 12 of the drawings, will effect complete and safe removal of the electrical plug 20 from the wall outlet 90. Thus, the elderly, handicapped and others who may have disabilities or a nervous or muscular disease can easily and safely remove an electrical plug 20 from an electrical outlet 90.

Once an electrical plug 20 has been removed from an wall outlet 90 utilizing applicant's new and novel electrical plug removal device 32, the electrical plug removal device 32 may be left in place on the electrical plug 20 for future use. Since the at least two joining means 60 and at least two joining means receptacles 62, not shown in FIG. 12 of the drawings but clearly illustrated in FIGS. 9 and 10 of the drawings, removably join portions of the electrical plug removal device 32, a user can remove the electrical plug removal device 32 from the electrical plug 20 for use on other electrical plugs. There are many instances where a person may need to repeatedly plug in and unplug an electrical plug 20. For example, irons, toasters and coffee makers are seldom left plugged in an electrical wall outlet 90 for extended periods of time. Generally, people plug in and unplug theses types of devices repeatedly. Applicant's new and novel electrical plug removal device 32 thus safely and easily eliminates the stress on electrical cord 22 and other components of an electrical plug 20 as previously described, thereby reducing the danger of electric shock, electrocution or electrical fire.

Referring now to FIGS. 13 through 20 of the drawings there are shown modifications of applicant's new and novel electrical plug removal device 32. Since there are a wide variety of shapes and configurations of electrically conductive spaced apart blades 26 and electrically conductive spaced apart ground blades 28 that may be present on various prior art electrical plugs 20, not shown in FIGS. 13 through 20 for purposes of clarity, applicant's new and novel electrical plug removal device 32 may be constructed with varying spaced apart electrical plug blade receiving means 68 and 70 which correspond to the shape and configuration of the electrically conductive spaced apart blades 26 and electrically conductive spaced apart ground blades 28 that may be present on a particular prior art electrical plug to be used. FIGS. 13 through 20 are top plan views showing a central portion 46 of electrical plug removal device 32 and illustrating different shapes and configurations of spaced apart electrical plug blade receiving means 68 and 70 that may be embodied in applicant's new and novel electrical plug removal device 32. Portions of electrical plug removal device 32 have not been shown in FIGS. 13 through 20 of the drawings for purposes of clarity.

Figure 13:
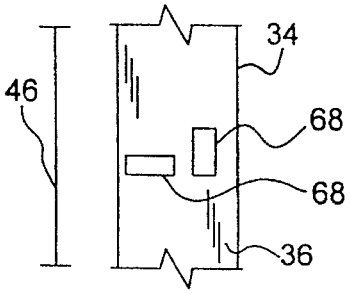
FIG. 13 is a top plan view showing an embodiment of electrical plug blade receiving means in a central portion of applicant's new and novel electrical plug removal device.

FIG. 13 of the drawings illustrates a configuration of spaced apart electrical plug blade receiving means 68 that may be used for prior art electrical plugs having a corresponding configuration of electrically conductive spaced apart blades.

Figure 14:
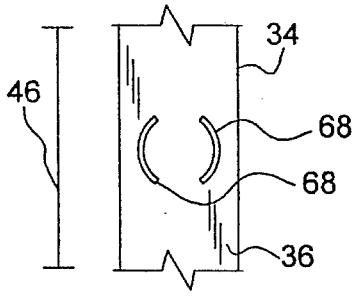
FIG. 14 is a top plan view showing another embodiment of electrical plug blade receiving means in a central portion of applicant's new and novel electrical plug removal device.

FIG. 14 of the drawings illustrates another configuration of semi-circular shaped spaced apart electrical plug blade receiving means 68 that may be used for prior art electrical plugs having a corresponding configuration and semi-circular shape of electrically conductive spaced apart blades.

Figure 15:
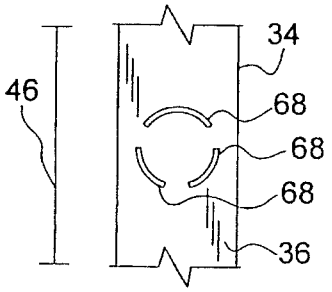
FIG. 15 is a top plan view showing another embodiment of electrical plug blade receiving means in a central portion of applicant's new and novel electrical plug removal device.

FIG. 15 of the drawings illustrates another configuration and number of semi-circular shaped spaced apart electrical plug blade receiving means 68 that may be used for prior art electrical plugs having a corresponding configuration and number of semi-circular shaped electrically conductive spaced apart blades.

Figure 16:
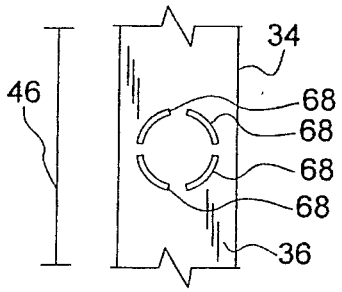
FIG. 16 is a top plan view showing another embodiment of electrical plug blade receiving means in a central portion of applicant's new and novel electrical plug removal device.

FIG. 16 of the drawings illustrates still another configuration and number of semi-circular shaped spaced apart electrical plug blade receiving means 68 that may be used for prior art electrical plugs having a corresponding configuration and number of semi-circular shaped electrically conductive spaced apart blades.

Figure 17:
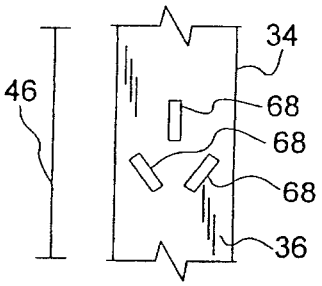
FIG. 17 is a top plan view showing another embodiment of electrical plug blade receiving means in a central portion of applicant's new and novel electrical plug removal device.

FIG. 17 of the drawings illustrates yet another configuration and number of spaced apart electrical plug blade receiving means 68 that may be used for prior art electrical plugs having a corresponding configuration and number of electrically conductive spaced apart blades.

Figure 18:
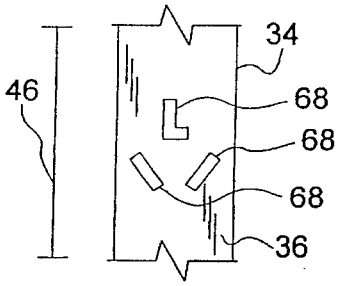
FIG. 18 is a top plan view showing another embodiment of electrical plug blade receiving means in a central portion of applicant's new and novel electrical plug removal device.

FIG. 18 of the drawings illustrates another configuration and number of spaced apart electrical plug blade receiving means 68 that may be used for prior art electrical plugs having a corresponding configuration and number of electrically conductive spaced apart blades.

Figure 19:
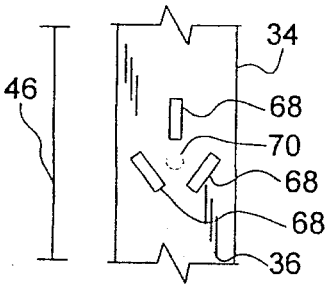
FIG. 19 is a top plan view showing another embodiment of electrical plug blade receiving means in a central portion of applicant's new and novel electrical plug removal device.

FIG. 19 of the drawings is similar to FIG. 17 and illustrates still another configuration and number of spaced apart electrical plug blade receiving means 68 and spaced apart electrical plug blade receiving means 70 that may be used for prior art electrical plugs having a corresponding configuration and number of electrically conductive spaced apart blades and electrically conductive spaced apart ground blade, respectively.

Figure 20:
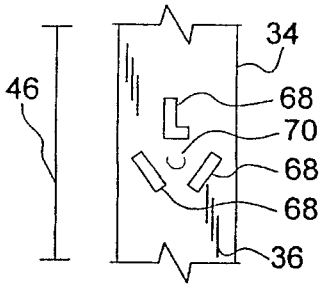
FIG. 20 is a top plan view showing another embodiment of electrical plug blade receiving means in a central portion of applicant's new and novel electrical plug removal device.

Finally, FIG. 20 of the drawings is similar to FIG. 18 and illustrates yet another configuration and number of spaced apart electrical plug blade receiving means 68 and spaced apart electrical plug blade receiving means 70 that may be used for prior art electrical plugs having a corresponding configuration and number of electrically conductive spaced apart blades and electrically conductive spaced apart ground blade, respectively.

It is evident from the foregoing illustrations that there are a variety of configurations, shapes and number of prior art electrically conductive spaced apart blades and electrically conductive spaced apart ground blades. The embodiments shown in FIGS. 13 through 20 showing some of the possible configurations of the spaced apart electrical plug blade receiving means 68 and 70 continuously formed in applicant's new and novel electrical plug removal device 32 are for purposes of illustration only. Other shapes, designs, configurations, sizes and numbers of spaced apart electrical plug blade receiving means may also be used and are considered to be within the spirit and scope of the applicant's invention.

Referring now to FIGS. 21 through 24 of the drawings there will be described other modifications of applicant's new and novel electrical plug removal device 32. Since the thickness of the non-conductive semi-flexible material from which the electrical plug removal device 32 is continuously formed varies to correspond to the particular shape and configuration of the electrically conductive spaced apart blades and electrically conductive spaced apart ground blades on different particular prior art electrical plugs on which the electrical plug removal device 32 is to be used, the configuration of the at least two joining means 60 or the at least two joining means receptacles 62 or both may be modified to accommodate the varying thickness of the electrical plug removal device 32 to allow the end 38 and the opposite end 40 of the electrical plug removal device 32 to be removably joined. Portions of 32, end 38 and opposite end 40 have not been shown in FIGS. 21 through 24 for purposes of clarity.

Figure 21:
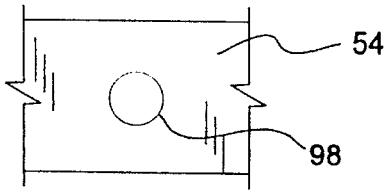
FIG. 21 is an enlarged view of a modification of applicant's new and novel electrical plug removal device.

Referring now to FIG. 21 of the drawings there is shown an enlarged view of a portion of fourth arm 54 showing a modified at least two joining means receptacles shown generally by the numeral 98. A modified at least two joining means receptacles 98 is an open area or hole continuously centrally formed in fourth arm 54. Similarly, another modified at least two joining means receptacles 98 is continuously centrally formed in third arm 52 which is not shown in FIG. 21 of the drawings for purposes of clarity.

Figure 22:
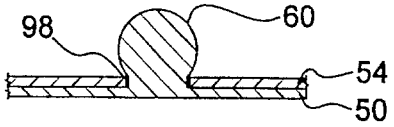
FIG. 22 is an enlarged cross sectional view of a modification of applicant's new and novel electrical plug removal device.

Referring now to FIG. 22 of the drawings there is shown an enlarged cross sectional view of second arm 50 and fourth arm 54 in a removably locked position utilizing one of the modified at least two joining means receptacles 98 similar to FIG. 10 of the drawings. Still referring to FIG. 22, it can be seen how the modified at least two joining means receptacles 98, continuously formed in fourth arm 54, allows the ball of one of the at least two joining means 60, continuously formed on second arm 50, to pass through the non-conductive semi-flexible material from which the electrical plug removal device 32 is continuously formed. Thus, if the thickness of the electrical plug removal device 32 is minimal, the modified at least two joining means receptacles 98 allows the end 38 and the opposite end 40 of the electrical plug removal device 32 to be securely removably joined. Similarly, another modified at least two joining means receptacles 98 continuously formed in third arm 52 allows the ball of another of the at least two joining means 60 continuously formed on first arm 48, to pass through the non-conductive semi-flexible material from which the electrical plug removal device 32 is continuously formed. First arm 48 and third arm 52 are not shown in FIG. 22 of the drawings for purposes of clarity.

Figure 23:
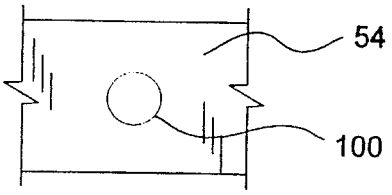
FIG. 23 is an enlarged view of another modification of applicant's new and novel electrical plug removal device.

Referring now to FIG. 23 of the drawings there is shown another modification of applicant's new and novel electrical plug removal device 32. FIG. 23 is an enlarged view of a portion of second arm 50 of the electrical plug removal device 32 showing a modified at least two joining means 100. A modified at least two joining means 100 is an open area or hole continuously centrally formed in second arm 50. Similarly, another modified at least two joining means 100 is continuously centrally formed in first arm 48 which is not shown in FIG. 23 of the drawings for purposes of clarity.

Figure 24:
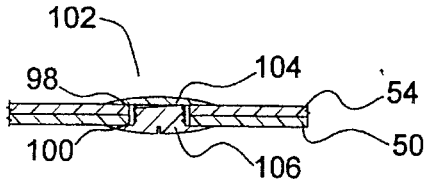
FIG. 24 is an enlarged cross sectional view of another modification of applicant's new and novel electrical plug removal device.

Referring now to FIG. 24 of the drawings there is shown an enlarged cross sectional view of second arm 50 and fourth arm 54 in a removably locked position utilizing one of the modified at least two joining means receptacles 98 and one of the modified at least two joining means 100, FIG. 24 being similar to FIG. 22 of the drawings. Still referring to FIG. 24 of the drawings it can be seen how the modified at least two joining means receptacles 98 and the modified at least two joining means 100 allows a fastener, shown generally by the numeral 102, to be inserted through the modified at least two joining means receptacles 98 and the modified at least two joining means 100 thereby removably joining end 38 and opposite end 40 of electrical plug removal device 32. Portions of the electrical plug removal device 32, end 38 and opposite end 40 have not been shown in FIG. 24 for purposes of clarity. In the Preferred Embodiment, the fastener is a tee-nut 104 and screw 106 as illustrated in FIG. 24 of the drawings. Other fasteners and fastening means known in the art may also be used and are considered to be within the spirit and scope of the applicant's invention.

If the thickness of the electrical plug removal device 32 is minimal, the modified at least two joining means receptacles 98 and the modified at least two joining means 100 allows the end 38 and the opposite end 40 of the electrical plug removal device 32, not shown in its entirety in FIG. 24 for purposes of clarity to be securely removably joined. Similarly, another modified at least two joining means receptacles 98 continuously formed in third arm 52 and another modified at least two joining means 100 continuously formed in first arm 48 allows a tee-nut 104 and screw 106, or other fastening means, to pass through the non-conductive semi-flexible material from which the electrical plug removal device 32 is continuously formed. First arm 48 and third arm 52 are also not shown in FIG. 24 of the drawings for purposes of clarity.

Figure 25:
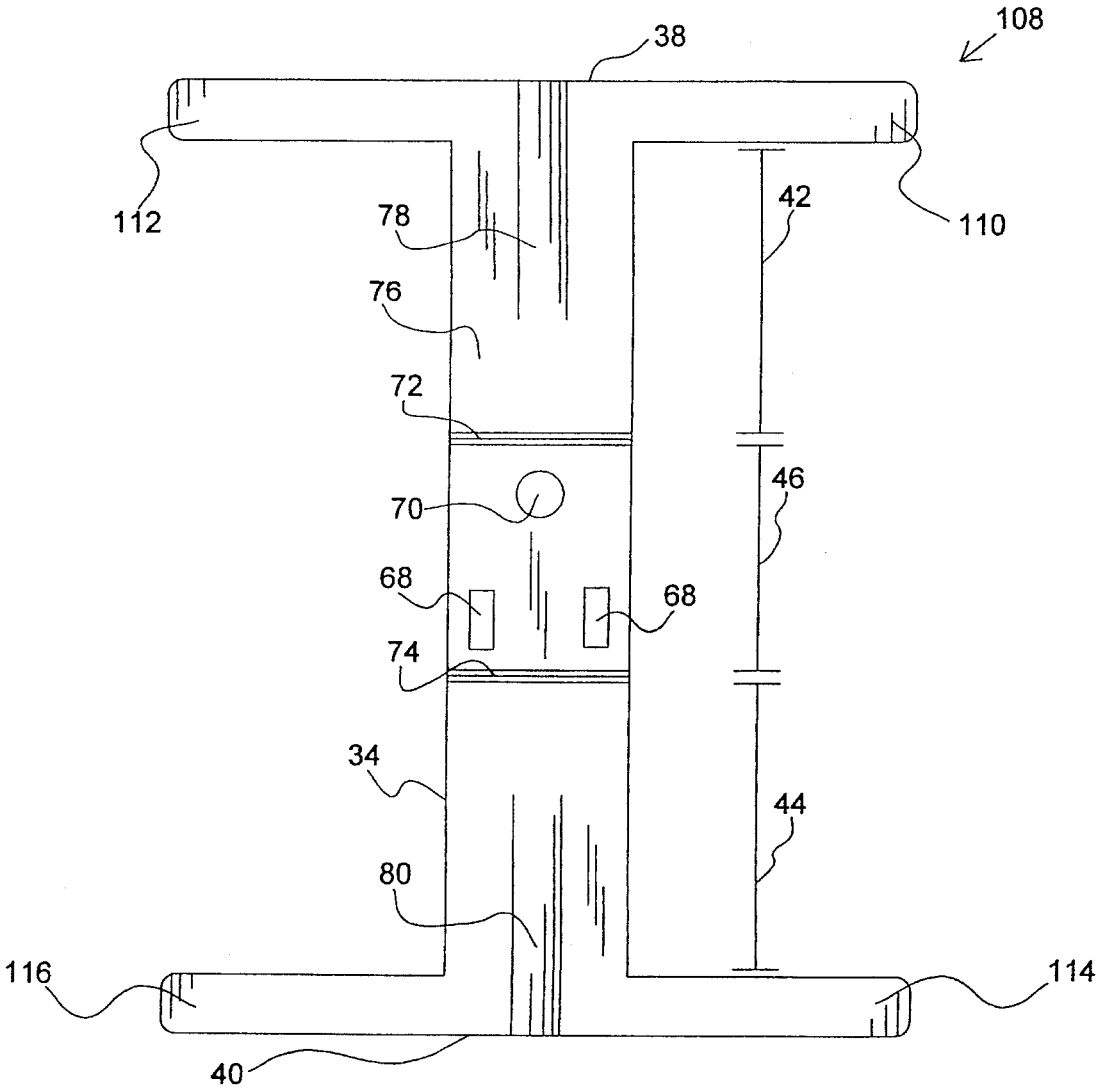
FIG. 25 is a bottom plan view of another modification of applicant's new and novel electrical plug removal device.

Referring now to FIG. 25 of the drawings there is shown another modification of applicant's new and novel electrical plug removal device. FIG. 25 is a bottom plan view of the modified electrical plug removal device shown generally by the numeral 108. An elongated main body 34, having an opposite surface 76, end 38, opposite end 40, end portion 42, opposite end portion 44 and central portion 46, has continuously and formed thereon a modified elongated first arm 110 and a modified elongated second arm 112, the modified elongated first arm 110 and the modified elongated second arm 112 being continuously and oppositely formed on end 38 of the elongated main body 34. Modified elongated third arm 114 and modified elongated fourth arm 116 are continuously and oppositely formed on opposite end 40 of elongated main body 34.

Figure 26:
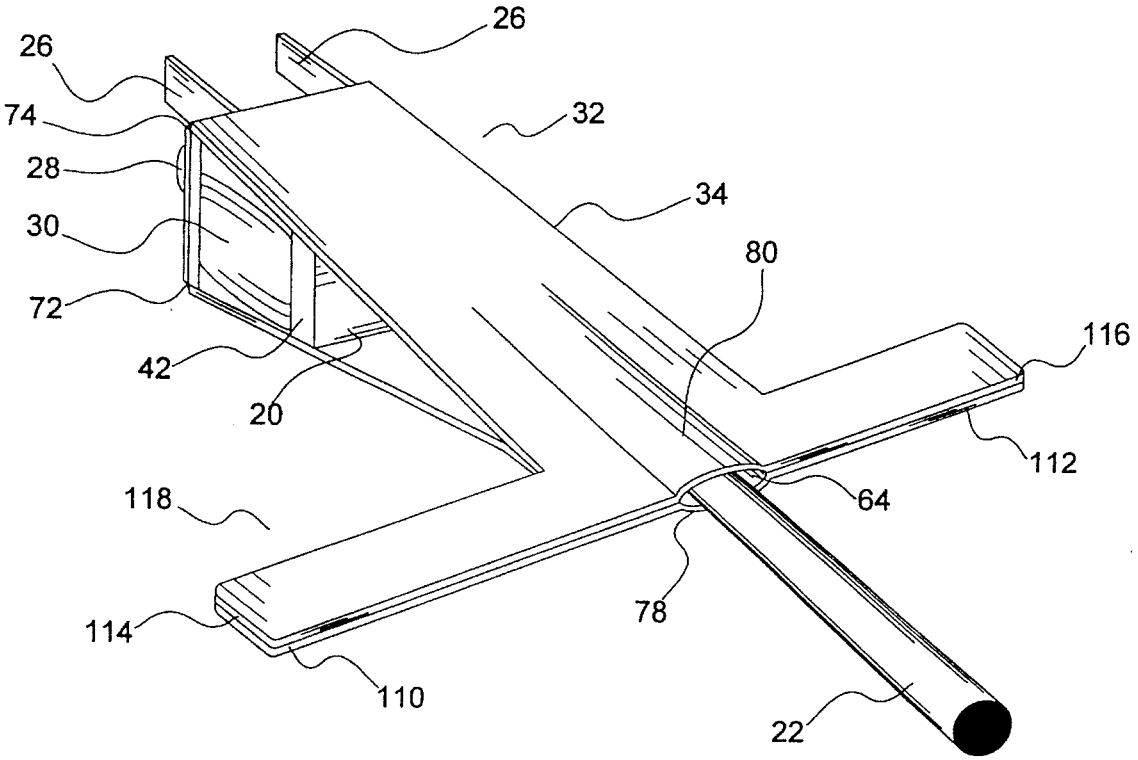
FIG. 26 is a perspective view of another modification of applicant's new and novel electrical plug removal device in position on a prior art electrical plug.

Referring now to FIG. 26 of the drawings there is shown a perspective view illustrating the modified electrical plug removal device, shown generally by the numeral 108, in position on a prior art electrical plug, shown generally by the numeral 20. Modified elongated arms 110, 112, 114 and 116 are designed to form a modified gripping means, shown generally by the numeral 118, when the modified elongated arms 110, 112, 114 and 116 are removably joined in a removably locked position. The manner in which the modified elongated arms 110, 112, 114 and 116 are removably joined is similar to that for joining first arm 48 to third arm 52 and second arm 50 to fourth arm 54, respectively, as previously described. First arm 48, second arm 50, third arm 52 and fourth arm 54 are not shown in FIG. 26 of the drawings for purposes of clarity, but are clearly shown in FIGS. 3 and 4 of the drawings.

Still referring to FIG. 26 of the drawings it can be seen how removably joining modified elongated first arm 110 and modified elongated third arm 114 and modified elongated second arm 112 and modified elongated fourth arm 116, respectively, forms modified gripping means 118 which can be utilized to remove a prior art electrical plug from an electrical outlet or receptacle, the prior art electrical plug and electrical outlet or receptacle not shown in FIG. 26 for purposes of clarity. In the Preferred Embodiment, modified gripping means 118 has been designed to form a T-shape, thereby forming a convenient handle which allows a user to remove a prior art electrical plug from an electrical outlet utilizing the modified electrical plug removal device 108. Other shapes and configurations may also be used and are considered to be within the spirit and scope of the applicant's invention.

From the above it can be seen that the applicant's new and novel electrical plug removal device accomplishes all of the objects and advantages presented herein before. Nevertheless it is within the spirit and scope of the invention that changes in the applicant's basic electrical plug removal device may be made and the Preferred Embodiment and the modifications shown and described herein have only been given by way of illustration.

Having described my invention, I claim:

1. An electrical plug removal device for use with an electrical plug, the electrical plug being of the type having an electrical cord, a plug and electrically conductive spaced apart blades, the electrical plug removal device being removably locked in position on said electrical plug, the electrical plug removal device being non-conductive and semi-flexible, the electrical plug removal device providing safe and easy removal of said electrical plug from an electrical outlet, comprising:

a. an elongated main body having an end, an opposite end, an end portion, an opposite end portion, a central portion, a surface and an opposite surface, the elongated main body being non-conductive and semi-flexible;

b. arms continuously formed on the elongated main body, the arms being non-conductive and semi-flexible, wherein a first arm of said arms is continuously formed on the end of the elongated main body, a second arm of said arms is continuously formed on the end of the elongated main body, the first and second arms being continuously and oppositely formed on the end of the elongated main body, and further wherein a third arm of said arms is continuously formed on the opposite end of the elongated main body and a fourth arm of said arms is continuously formed on the opposite end of the elongated main body, the third and fourth arms being continuously and oppositely formed on the opposite end of the elongated main body;

c. gripping means continuously formed on the third and fourth arms of the elongated main body, the gripping means being non-conductive and semi-flexible, the gripping means being oval and having an open area wherein a user may grasp the gripping means;

d. at least two joining means continuously formed on the first and second arms;

e. at least two joining means receptacles continuously formed in the third and fourth arms, the at least two joining mean, receptacles removably engaging the at least two joining means;

f. U-shaped channels continuously formed in the surface of the elongated main body, one of said U-shaped channels being continuously centrally formed in the surface of the elongated main body having an upward angular slope, the upward angular slope beginning at the end of the elongated main body and intersecting the surface of the elongated main body near the central portion of the elongated main body, another of said U-shaped channels being continuously centrally formed in the surface of the elongated main body having an upward angular slope, the upward angular slope beginning at the opposite end of the elongated main body and intersecting the surface of the elongated main body near the central portion of the elongated main body, wherein the U-shaped channels removably encompass said electrical cord when the at least two joining means receptacles removably engage the at least two joining means;

g. spaced apart electrical plug blade receiving means continuously formed in the central portion of the elongated main body, the spaced apart electrical plug blade receiving means being designed to accept the electrically conductive blades of said electrical plug;

h. grooves continuously transversely formed in the opposite surface of the elongated main body, one of said grooves being continuously transversely formed in the opposite surface of the elongated main body between the end portion and the central portion of the elongated main body, another of said grooves being continuously transversely formed in the opposite surface of the elongated main body between the opposite end portion and the central portion of the elongated main body, wherein the grooves allow portions of the elongated main body to fold over said electrical plug; and i. raised portions continuously formed on the opposite surface of the elongated main body, the raised portions being produced by the U-shaped channels.

2. The electrical plug removal device as defined in claim 1 wherein the at least two joining means are a stem and ball configuration continuously formed on the first and second arms.

3. The electrical plug removal device as defined in claim 1 wherein the at least two joining means receptacles are sockets continuously formed in the third and fourth arms.

4. The electrical plug removal device as defined in claim 1 wherein the at least two joining means receptacles are holes continuously formed in the third and fourth arms.

5. The electrical plug removal device as defined in claim 4 wherein the at least two joining means are holes continuously formed in the first and second arms, the holes capable of receiving fastening means.

6. The electrical plug removal device as defined in claim 5 wherein the at least two joining means and the at least two joining means receptacles are removably joined by said fastening means.

7. The electrical plug removal device as defined in claim 6 wherein the fastening means are tee-nuts and screws.

8. The electrical plug removal device as defined in claim 1 wherein the arms are elongated, the elongated arms forming a T-shaped gripping means.

9. An electrical plug removal device for use with an electrical plug of the type having an electrical cord, a plug and electrically conductive spaced apart blades, the electrical plug removal device being removably locked in position on said electrical plug, the electrical plug removal device aiding in the removal of said electrical plug from an electrical outlet, the electrical plug removal device being constructed of non-conductive semi-flexible material thereby providing safe and easy removal of said electrical plug from said electrical outlet, comprising: an elongated main body, the elongated main body having an end, an opposite end, an end portion, an opposite end portion, a central portion, a surface and an opposite surface; arms continuously formed on the elongated main body, a first arm of said arms and a second arm of said arms being continuously oppositely formed on the end of the elongated main body and a third arm of said arms and a fourth arm of said arms being continuously oppositely formed on the opposite end of the elongated main body; at least two joining means continuously formed on the first and second arms, the at least two joining means being continuously formed on the first and second arms to rise from the surface of the elongated main body; at least two joining means receptacles continuously formed in the third and fourth arms, the a least two joining means receptacles being continuously formed in the third and fourth arms of the elongated main body, the at least two joining means receptacles removably engaging the at least two joining means; U-shaped channels continuously formed in the surface of the elongated main body, one of said U-shaped channels being continuously centrally formed in the surface of the elongated main body having an upward angular slope, the upward angular slope beginning at the end of the elongated main body and intersecting the surface of the elongated main body near the central portion of the elongated main body, another one of said U-shaped channels being continuously centrally formed in the surface of the elongated main body having an upward angular slope, the upward angular slope beginning at the opposite end of the elongated main body and intersecting the surface of the elongated main body near the central portion of the elongated main body, the U-shaped channels removably encompassing an electrical cord; spaced apart electrical plug blade receiving means continuously formed in the central portion of the elongated main body, the spaced apart electrical plug blade receiving means being designed to accept electrically conductive blades of said electrical plug; grooves continuously transversely formed in the opposite surface of the elongated main body, one of said grooves being continuously transversely formed in the opposite surface of the elongated main body between the end portion and the central portion of the elongated main body, another one of said grooves being continuously transversely formed in the opposite surface of the elongated main body between the opposite end portion and the central portion of the elongated main body; raised portions continuously formed on the opposite surface of the elongated main body, the raised portions resulting from the angular upward slope of the U-shaped channels.

10. The electrical plug removal device as defined in claim 9 wherein the at least two joining means are a stem and ball configuration.

11. The electrical plug removal device as defined in claim 9 wherein the at least two joining means receptacles are sockets.

12. The electrical plug removal device as defined in claim 9 wherein the at least two joining means receptacles are holes.

13. The electrical plug removal device as defined in claim 12 wherein the at least two joining means are holes, the holes capable of receiving fastening means.

14. The electrical plug removal device as defined in claim 13 wherein the at least two joining means and the at least two joining means receptacles are removably joined by said fastening means.

15. The electrical plug removal device as defined in claim 14 wherein the fastening means are tee-nuts and screws.

16. An electrical plug removal device for use with an electrical plug, the electrical plug being of the type having an electrical cord, a plug and electrically conductive spaced apart blades, the electrical plug removal device being removably locked in position on said electrical plug, the electrical plug removal device being non-conductive and semi-flexible, the electrical plug removal device providing safe and easy removal of said electrical plug from an electrical outlet, comprising:

a. an elongated main body having an end, an opposite end, an end portion, an opposite end portion, a central portion, a surface and an opposite surface, the elongated main body being non-conductive and semi-flexible;

b. elongated arms continuously formed on the elongated main body, the elongated arms being non-conductive and semi-flexible, wherein a first elongated arm of said elongated arms is continuously formed on the end of the elongated main body, a second elongated arm of said elongated arms is continuously formed on the end of the elongated main body, the first and second elongated arms also being continuously and oppositely formed on the end of the elongated main body, and further wherein a third elongated arm of said elongated arms is continuously formed on the opposite end of the elongated main body and a fourth elongated arm of said elongated arms is continuously formed on the opposite end of the elongated main body, the third and fourth elongated arms also being continuously and oppositely formed on the opposite end of the elongated main body;

c. at least two joining means continuously formed on the first and second elongated arms;

d. at least two joining means receptacles continuously formed in the third and fourth elongated arms, the at least two joining means receptacles removably engaging the at least two joining means;

e. gripping means continuously formed on the end and opposite end of the elongated main body, wherein the gripping means are further comprised of the elongated arms;

f. U-shaped channels continuously formed in the surface of the elongated main body, one of said U-shaped channels being continuously centrally formed in the surface of the elongated main body having an upward angular slope, the upward angular slope beginning at the end of the elongated main body and intersecting the surface of the elongated main body near the central portion of the elongated main body, another of said U-shaped channels being continuously centrally formed in the surface of the elongated main body having an upward angular slope, the upward angular slope beginning at the opposite end of the elongated main body and intersecting the surface of the elongated main body near the central portion of the elongated main body, wherein the U-shaped channels removably encompass said electrical cord;

g. spaced apart electrical plug blade receiving means continuously formed in the central portion of the elongated main body, the spaced apart electrical plug blade receiving means being designed to accept said electrically conductive blades of said electrical plug;

h. grooves continuously transversely formed in the opposite surface of the elongated main body, one of said grooves being continuously transversely formed in the opposite surface of the elongated main body between the end portion and the central portion of the elongated main body, another of said grooves being continuously transversely formed in the opposite surface of the elongated main body between the opposite end portion and the central portion of the elongated main body, wherein the grooves allow portions of the elongated main body to fold over said electrical plug; and i. raised portions continuously formed on the opposite surface of the elongated main body, the raised portions being produced by the U-shaped channels.

17. The electrical plug removal device as defined in claim 16 wherein the at least two joining means are a stem and ball configuration continuously formed on the first and second elongated arms.

18. The electrical plug removal device as defined in claim 16 wherein the at least two joining means receptacles are sockets continuously formed in the third and fourth elongated arms.

19. The electrical plug removal device as defined in claim 16 wherein the at least two joining means and the at least two joining means receptacles are holes, the holes capable of receiving fastening means.

20. The electrical plug removal device as defined in claim 19 wherein the at least two joining means and the at least two joining means receptacles are removably joined by said fastening means.

* * * * *